US007829487B2

(12) United States Patent
Suzuki et al.

(10) Patent No.: US 7,829,487 B2
(45) Date of Patent: Nov. 9, 2010

(54) EXTENSIBLE NONWOVEN FABRIC AND COMPOSITE NONWOVEN FABRIC COMPRISING THE SAME

(75) Inventors: Kenichi Suzuki, Sodegaura (JP); Hisashi Morimoto, Sodegaura (JP); Katsuaki Harubayashi, Sodegaura (JP); Shigeyuki Motomura, Sodegaura (JP); Pingfan Chen, Sodegaura (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 31 days.

(21) Appl. No.: 10/535,264

(22) PCT Filed: Nov. 25, 2003

(86) PCT No.: PCT/JP03/15000

§ 371 (c)(1),
(2), (4) Date: May 17, 2005

(87) PCT Pub. No.: WO2004/048661

PCT Pub. Date: Jun. 10, 2004

(65) Prior Publication Data

US 2006/0052022 A1 Mar. 9, 2006

(30) Foreign Application Priority Data

Nov. 25, 2002 (JP) ..... 2002-341548

(51) Int. Cl.
*D04H 3/00* (2006.01)
*D04H 3/16* (2006.01)

(52) U.S. Cl. ..... 442/364; 442/328; 442/329; 442/361; 442/401

(58) Field of Classification Search ..... 442/361, 442/328, 329, 401; 428/373, 364, 365
See application file for complete search history.

(56) References Cited

U.S. PATENT DOCUMENTS

| | | | | |
|---|---|---|---|---|
| 6,156,679 | A * | 12/2000 | Takaoka et al. | 442/327 |
| 6,274,237 | B1 * | 8/2001 | Nakajima et al. | 428/370 |
| 6,274,238 | B1 * | 8/2001 | DeLucia | 428/373 |
| 6,723,669 | B1 * | 4/2004 | Clark et al. | 442/347 |
| 2004/0038612 | A1 * | 2/2004 | Forbes et al. | 442/361 |

FOREIGN PATENT DOCUMENTS

| | | | |
|---|---|---|---|
| EP | 1039007 | A1 * | 9/2000 |
| JP | 9-512313 | A | 12/1997 |
| JP | 11-323716 | A | 11/1999 |
| JP | 2002-146663 | A | 5/2002 |
| WO | 96/16216 | A1 | 5/1996 |
| WO | 01/49905 | A2 | 7/2001 |
| WO | 01/49908 | A | 7/2001 |

* cited by examiner

*Primary Examiner*—Jennifer A Chriss
(74) *Attorney, Agent, or Firm*—Buchanan Ingersoll & Rooney PC

(57) ABSTRACT

An extensible nonwoven fabric comprises a fiber comprising at least two olefin-based polymers. These olefin-based polymers are of the same kind and have different induction periods of strain-induced crystallization as measured at the same temperature and shear strain rate. A composite nonwoven fabric of the invention comprises at least one layer comprising the extensible nonwoven fabric.

5 Claims, 4 Drawing Sheets

EXTENSIBLE NONWOVEN FABRIC AND COMPOSITE NONWOVEN FABRIC COMPRISING THE SAME

TECHNICAL FIELD

The present invention relates to an extensible nonwoven fabric. More particularly, the invention relates to an extensible nonwoven fabric which is capable of extension during mechanical stretching, has excellent fuzz resistance, surface abrasion resistance, formability and productivity, and can be heat-embossed at low temperatures. The invention also relates to a composite nonwoven fabric produced by laminating the nonwoven fabric and to a disposable diaper comprising the nonwoven fabric.

BACKGROUND OF THE INVENTION

Nonwoven fabrics have wide applications including clothes, disposable diapers and personal hygiene products. The nonwoven fabrics for such applications are required to have excellent properties, such as touch, conformability to the body, conformity during body movements, drape, tensile strength and surface abrasion resistance.

Traditional nonwoven fabrics made from a monocomponent fiber, while being resistant to fuzzing and comfortable to the touch, are unsatisfactory in extensibility. Accordingly, there has been a difficulty in using such nonwoven fabrics in diapers and the like where both comfortable touch and good extensibility are required.

It has been believed that the nonwoven fabrics are desirably imparted with elastic properties in order to meet the above requirements, and various methods have been proposed for imparting elastic properties. For example, mechanical stretching of composite nonwoven fabrics that include at least one elastic layer and at least one substantially inelastic layer can produce elastic properties. However, the composite nonwoven fabrics by this method have problems in that the inelastic fiber is damaged or broken during the mechanical stretching to produce fuzz and the fabric strength is lowered.

In consideration of such problems, studies have been being carried out in order to impart high extensibility to the inelastic fibers. For example, JP-A-9/512313 and WO 01/49905 propose composite nonwoven fabrics that comprise multipolymer fibers containing two or more different polymers as the inelastic fibers. The multipolymer fibers contained in the composite nonwoven fabrics have achieved high extensibility. However, the composite nonwoven fabrics according to the teachings of these publications suffer fuzzing and have inferior touch.

OBJECT OF THE INVENTION

It is an object of the present invention to provide an extensible nonwoven fabric which is excellent in strength, extensibility, fuzz resistance, surface abrasion resistance, formability and productivity and which can be heat-embossed at low temperatures. It is another object of the invention to provide a composite nonwoven fabric produced by laminating the extensible nonwoven fabric.

DISCLOSURE OF THE INVENTION

The present inventors earnestly studied with a view to solving the aforesaid problems. As a result, they have found that a fiber that comprises olefin-based polymers of the same kind having different induction periods of strain-induced crystallization at the same temperature can exhibit high extensibility. The present invention has been completed based on this finding.

The extensible nonwoven fabric according to the invention comprises a fiber comprising at least two olefin-based polymers, these at least two olefin-based polymers being of the same kind and having different induction periods of strain-induced crystallization as measured at the same temperature and the same shear strain rate.

Preferably, the fiber is a conjugate fiber having a cross section in which a component in point (a) and a component in point (b) which is symmetric about the center point are the same.

Preferably, the extensible nonwoven fabric is a spunbonded nonwoven fabric.

Preferably, the extensible nonwoven fabric has an extensibility at a maximum load of not less than 70% in the machine direction (MD) and/or in the cross machine direction (CD).

Preferably, the olefin-based polymer is a propylene-based polymer.

The composite nonwoven fabric according to the invention comprises at least one layer comprising the extensible nonwoven fabric as described above. The disposable diaper of the invention includes the extensible nonwoven fabric as described above.

DESCRIPTION OF THE PREFERRED EMBODIMENTS

The extensible nonwoven fabric and the composite nonwoven fabric produced by laminating the same according to the invention will be described hereinbelow.

Extensible Nonwoven Fabric (Induction Period of Strain-Induced Crystallization)

Figure 1:
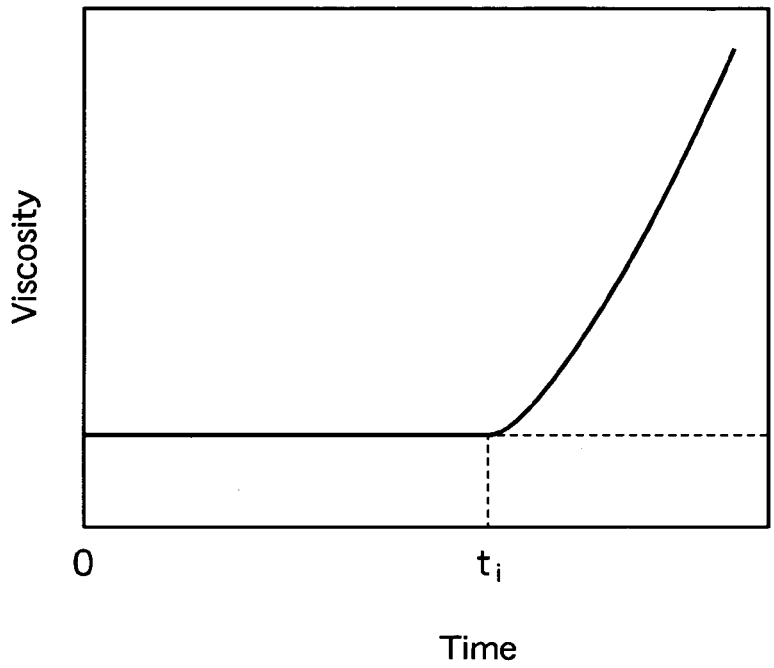
FIG. 1 is a graph showing changes in melt shear viscosity measured in the invention with time.

First, the "induction period of strain-induced crystallization" used in the specification will be described. The induction period of strain-induced crystallization refers to a time from when a melt shear viscosity of a polymer starts to be measured at a constant measurement temperature and a fixed shear strain rate till when the viscosity begins to increase. Specifically, it is a time $t_i$ illustrated in FIG. 1. That is, it denotes a time from the start of the measurement till when the melt shear viscosity that has been constant changes (increases).

Melt shear viscometers for use in the measurement of the melt shear viscosity include rotational rheometers and capillary rheometers. The shear strain rate is preferably 3 rad/s or less in view of maintaining a stable flow when the crystallization has occurred to some extent.

The flow field in a practical spinning is different from that in the above measurement, and the strain rate is very high. The strain-induced crystallization of a polymer occurs when the total strain in the system has reached a certain level. Therefore, the induction period of strain-induced crystallization is in inverse proportion to the shear strain rate, and the induction period of strain-induced crystallization at a high shear strain rate can be estimated from the induction period at a lower shear strain rate. Similarity between the flow field in the spinning and that in the above measurement is that polymer molecules are oriented by the flow. Therefore, it could be possible to estimate the phenomenon in the elongational flow filed in the practical spinning based on the results obtained at a lower shear strain rate.

The induction period of strain-induced crystallization will be measured at a temperature not lower than the static crystallization temperature, and preferably at between the static crystallization temperature and the equilibrium melting point. The measurement temperature is not particularly limited as long as the induction periods of strain-induced crystallization of the polymers used can be compared at the temperature, that is, the difference in induction periods of strain-induced crystallization among the polymers can be distinct. Preferably, the induction periods of strain-induced crystallization are compared at the highest of the temperatures at which the resulting induction periods of strain-induced crystallization are comparable. The induction periods of strain-induced crystallization will be preferably different from each other by 50 seconds or longer, and more preferably by 100 seconds or longer. The greater the difference, the more remarkable the effect of the invention.

Whether or not the induction periods of strain-induced crystallization will differ from each other may be assumed based on the differences of the melt flow rates (MFR) and of the melting points measured under the same conditions. Specifically, the polymers having different induction periods of strain-induced crystallization can be the following combinations (i) to (iii):

(i) Polymers having different MFR and different melting points;

(ii) Polymers having the same MFR and different melting points;

(iii) Polymers having different MFR and the same melting point.

Polymers with the same MFR and the same melting point have the same induction period of strain-induced crystallization.

<Olefin-Based Polymer>

The olefin-based polymers for use in the invention include α-olefin homopolymers and copolymers. Preferably, the olefin-based polymers will be ethylene or propylene homopolymers, or copolymers of propylene and at least one α-olefin selected from α-olefins other than the propylene (hereinafter the "propylene copolymers"). The ethylene or propylene homopolymers are more preferable. Particularly preferred are the propylene homopolymers from the viewpoint of preventing fuzzing, and thus they are suitably used in disposable diapers.

The α-olefins other than propylene include ethylene and α-olefins of 4 to 20 carbon atoms. Of these, ethylene and α-olefins of 4 to 8 carbon atoms are preferable, and ethylene, 1-butene, 1-pentene, 1-hexene, 1-octene and 4-methyl-1-pentene are more preferable.

The "olefin-based polymers of the same kind" as used in the invention will be defined in the following (1) to (3). The descriptions in (1) and (2) explain the cases where the olefin-based polymers are single polymers, and the description in (3) is for the case where the olefin-based polymers are blends of two or more olefin-based polymers.

(1) Olefin-Based Homopolymers

As used herein, the "homopolymer" will refer to a polymer containing 90% or more of a main structural unit. That is, a polypropylene containing an ethylene unit in an amount of less than 10% may be considered as a homopolypropylene. Accordingly, the expression "homopolymers of the same kind" means that they are, for example, all polyethylenes or all polypropylenes that may contain a minor structural unit in an amount of less than 10%.

(2) Olefin-Based Copolymers

The expression "copolymers of the same kind" means that all the copolymers have the same combination of structural units and that the proportional difference of each corresponding structural units is less than 10% among the copolymers. For example, an ethylene/propylene copolymer containing 80% propylene unit and 20% ethylene unit is of the same kind as an ethylene/propylene copolymer in which the propylene unit is more than 70% and less than 90% and the ethylene unit is more than 10% and less than 30%.

(3) Blends of Olefin-Based Polymers

In the invention, a blend comprising two or more polymers selected from the aforesaid homopolymers and copolymers may be used as an olefin-based polymer. These two or more polymers to be mixed together may be of the same or different kind. As used in the invention, the expression "polymer blends of the same kind" means that all the polymer blends have the same combination of polymer kinds and that the proportional difference of each corresponding polymers is less than 10% among the polymer blends. For example, a polymer blend containing 80 wt % polypropylene and 20 wt % polyethylene is of the same kind as a polymer blend in which the polypropylene content is more than 70 wt % and less than 90 wt % and the polyethylene content is more than 10 wt % and less than 30 wt %.

The polyethylene for use in the invention will preferably range in MFR, as measured at 190° C. under a load of 2.16 kg in accordance with ASTM D-1238, from 1 to 100 g/10 min, more preferably from 5 to 90 g/10 min, and particularly preferably from 10 to 85 g/10 min. Also preferably, the polyethylene will have an Mw/Mn ratio (Mw: weight-average molecular weight, Mn: number-average molecular weight) of 1.5 to 5. When the Mw/Mn ratio is within the above range, the fiber will be beautifully spun and the resultant fiber will have an excellent strength. As used herein, the "beautifully spinning" means that the resin can be extruded from a spinneret and drawn without filament breaking and the filament will not weld. In the invention, the weight-average molecular weight (Mw) and the number-average molecular weight (Mn) are the values in terms of polystyrene determined by a gel permeation chromatography (GPC) under the conditions of:

Column: two TSKgel GMH6HT columns and two TSKgel GMH6-HTL columns

Column temperature: 140° C.

Mobile phase: o-dichlorobenzene (ODCB)

Flow rate: 1.0 mL/min

Sample concentration: 30 mg/20 mL ODCB

Injection amount: 500 μL

The analysis sample is prepared by dissolving 30 mg of a sample in 20 mL of o-dichlorobenzene by heating them at 145° C. for 2 hours, and filtering the resultant solution through a sintered filter having 0.45 μm pores.

The polypropylene generally has an equilibrium melting point of 185 to 195° C. when its ethylene unit content is 0%. The polypropylene for use in the invention will preferably range in MFR, as measured at 230° C. under a load of 2.16 kg in accordance with ASTM D-1238, from 1 to 200 g/10 min, more preferably from 5 to 120 g/10 min, and particularly preferably from 10 to 100 g/10 min. Also preferably, the polypropylene will have an Mw/Mn ratio (Mw: weight-average molecular weight, Mn: number-average molecular weight) of 1.5 to 5.0, and more preferably 1.5 to 3.0. When the Mw/Mn ratio is within the above range, the fiber will be beautifully spun and the resultant fiber will have an excellent strength.

The at least two olefin-based polymers for use in the invention are prepared separately. Preferably, they are produced into pellets. When two or more kinds of polymers are used in one olefin-based polymer, they are preferably mixed together in a molten state and pelletized according to necessity.

<Additives>

In the invention, additives may be optionally used with the olefin-based polymers so long as the objects of the invention are not impaired. The additives include various stabilizers, such as heat stabilizers and weathering stabilizers, fillers, antistatic agents, hydrophilizing agents, slip agents, anti-blocking agents, anti-fogging agents, lubricants, dyes, pigments, natural oils, synthetic oils and waxes.

Exemplary stabilizers include anti-aging agents such as 2,6-di-t-butyl-4-methylphenol (BHT); phenol-based antioxidants such as tetrakis[methylene-3-(3,5-di-t-butyl-4-hydroxyphenyl)propionate]methane, β-(3,5-di-t-butyl-4-hydroxyphenyl) propionic acid alkyl ester, 2,2'-oxamidobis[ethyl-3-(3,5-di-t-butyl-4-hydroxyphenyl)] propionate and Irganox 1010 (trade name, hindered phenol type antioxidant); fatty acid metal salts such as zinc stearate, calcium stearate and calcium 1,2-hydroxystearate; and fatty acid esters of polyvalent alcohols such as glycerin monostearate, glycerin distearate, pentaerythritol monostearate, pentaerythritol distearate and pentaerythritol tristearate. These stabilizers may be used singly or in combination of two or more kinds.

Exemplary fillers include silica, diatomaceous earth, alumina, titanium oxide, magnesium oxide, pumice powder, pumice balloon, aluminum hydroxide, magnesium hydroxide, basic magnesium carbonate, dolomite, calcium sulfate, potassium titanate, barium sulfate, calcium sulfite, talc, clay, mica, asbestos, calcium silicate, montmorillonite, bentonite, graphite, aluminum powder and molybdenum sulfide.

Preferably, the additives will be used in a mixed condition with the olefin-based polymers. The additives may be mixed with one or more of the olefin-based polymers. The mixing method is not particularly limited and may be a traditional process.

<Fiber>

The fiber for use in the invention comprises at least two olefin-based polymers as described hereinabove. These two or more olefin-based polymers are of the same kind and have different induction periods of strain-induced crystallization as measured at the same temperature and the same shear strain rate. The fiber has substantially no crimps. By "having substantially no crimps", it is meant that the crimps of the fiber constituting the nonwoven fabric do not influence the extensibility of the nonwoven fabric.

Figure 2:
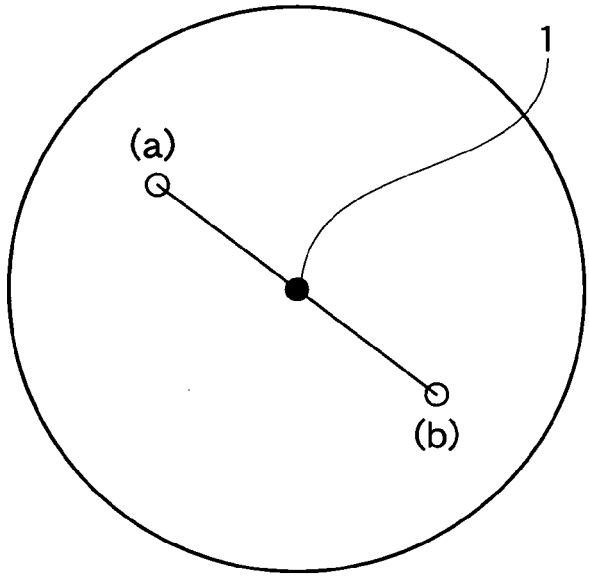
FIG. 2 is a sectional view of a fiber used in the invention, in which the referential number 1 indicates the center point of cross section.

The fiber is a conjugate fiber and, as illustrated in FIG. 2, preferably has a cross section in which the polymer component in point (a) and the polymer component in point (b) which is symmetric about the center point are the same. As used herein, the "conjugate fiber" will refer to a monofilament in which there are at least two phases that have a length/diameter ratio appropriate to be called as a fiber phase. Here, the diameter will be considered as of the cross section of fiber regarded as a circle. That is, the conjugate fiber used in the invention is a monofilament which contains at least two fiber phases comprising the olefin-based polymers that are of the same kind and have different induction periods of strain-induced crystallization.

Figure 3:
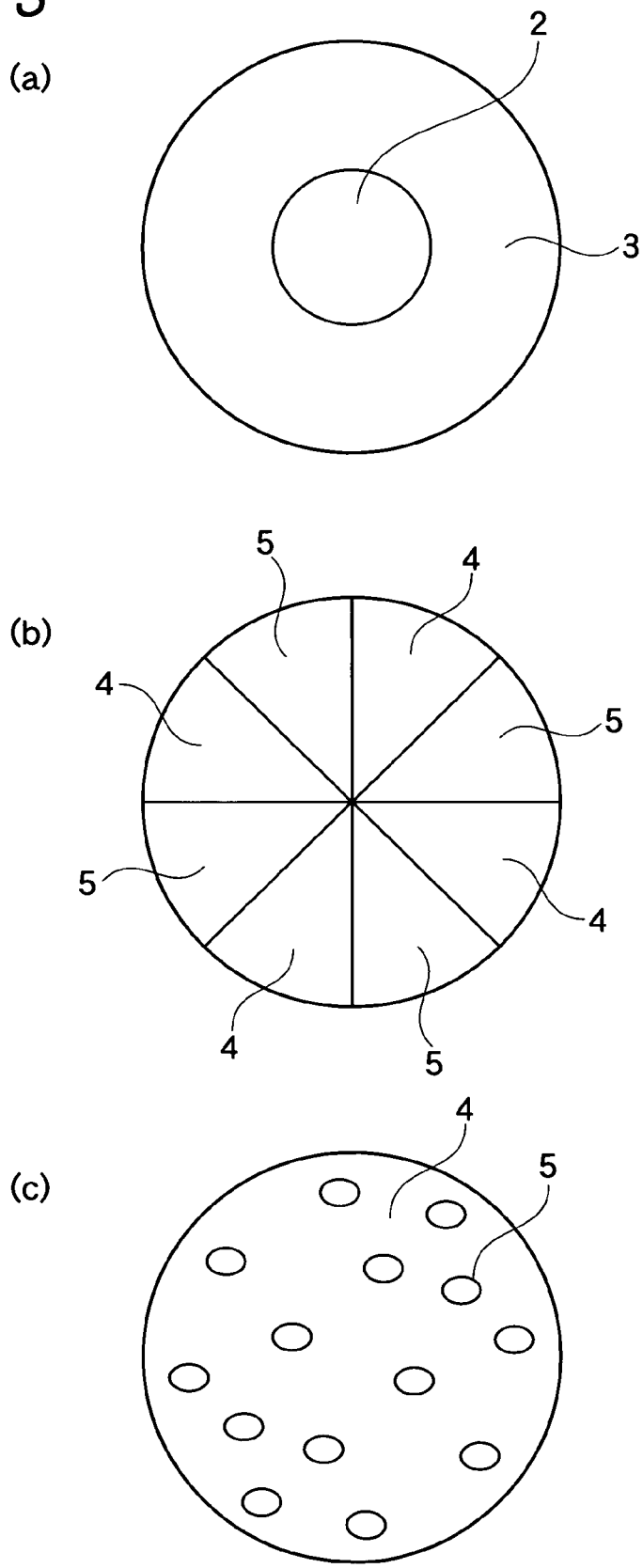
FIG. 3 is a set of sectional views of a conjugate fiber used in the invention, in which (a) shows a cross section of concentric sheath-core configuration, (b) shows a cross section of side-by-side configuration and (c) shows a cross section of islands-in-the-sea configuration, wherein the referential numbers 2 denotes a core portion, 3 denotes a sheath portion, 4 denotes a first component and 5 denotes a second component.

The conjugate fiber may have a sheath-core configuration, a side-by-side configuration or an islands-in-the-sea configuration across its cross section. Specifically, the sheath-core conjugate fiber can take a concentric configuration in which the circular core portion and the doughnut-shaped sheath portion are arranged in concentric relation. Of the above configurations, the concentric sheath-core configuration is preferable. These configurations across the cross section of conjugate fiber will be illustrated in FIG. 3, in which (a) shows a concentric sheath-core arrangement, (b) shows a side-by-side arrangement and (c) shows an islands-in-the-sea arrangement. In these configurations of the conjugate fiber, at least one component in every phase should be in a fiber form. For example, when the aforesaid polymer blends have constituted fiber phases, at least one component of the blend polymer should have a fiber form in every phase and others form a three-dimensional islands-in-the-sea structure within the fiber phase.

Among at least two olefin-based polymers constituting the fiber, the olefin-based polymer having the earliest (shortest) induction period of strain-induced crystallization is preferably contained in an amount of 1 to 70 wt %, more preferably 1 to 50 wt %, and particularly preferably 1 to 30 wt % of the fiber. When the olefin-based polymer with the earliest induction period of strain-induced crystallization is contained at above 70 wt %, the fiber cannot be beautifully spun. In that the concentric sheath-core conjugate fiber is beautifully spun and the resultant fiber has high extensibility, the core portion preferably comprises the olefin-based polymer having an earlier induction period of strain-induced crystallization.

<Nonwoven Fabric>

The extensible nonwoven fabric according to the invention contains the above fiber. Preferably, the extensible nonwoven fabric is a spunbonded nonwoven fabric.

The extensible nonwoven fabric preferably has a mass per unit area (basis weight) of 3 to 100 g/m$^2$, and more preferably 10 to 40 g/m$^2$. Having this basis weight, the extensible nonwoven fabric will be excellent in softness, touch, conformability to the body, conformity during body movements, drape, economical efficiency and see-through properties.

Preferably, the extensible nonwoven fabric will have an extensibility of not less than 70%, more preferably not less than 100%, even more preferably not less than 150%, and particularly preferably not less than 180% under a maximum load in the machine direction (MD) and/or in the cross machine direction (CD). Extensibility of less than 70% can cause fracture during the processing such as drawing, resulting in a noticeable loss in fabric strength and fuzzing. Therefore, it will be difficult to achieve satisfactory performances, such as good touch, when used in disposable diapers and similar products. Particularly, when the extensible nonwoven fabric with the basis weight of 10 to 40 g/m$^2$ has the extensibility of usually not less than 70%, preferably not less than 100%, more preferably not less than 150%, and particularly preferably not less than 180%, it will exhibit very excellent practical properties including touch and body conformity.

Preferably, the extensible nonwoven fabric will have a fineness of 5.0 denier or less. Having the fineness of not more than 5.0 denier, the nonwoven fabric will have excellent softness.

The extensible nonwoven fabric may be produced by a number of commonly known processes. For example, dry spinning, wet spinning, spunbonding and meltblowing may be employed. The spinning method may be appropriately selected depending on desired properties of the nonwoven fabric. The spunbonding method may be preferably used due to its high productivity and because it can produce highly strong nonwoven fabrics.

Hereinbelow, the method of producing the extensible nonwoven fabric will be described by reference to a production of spunbonded nonwoven fabric which contains concentric sheath-core conjugate fibers comprising two olefin-based polymers. It should be understood that the production method of the extensible nonwoven fabric is not limited to the following.

First, two olefin-based polymers will be produced separately. Herein, the additive(s) may be added to one or both of the two olefin-based polymers when needed. The olefin-based polymers are molten in a respective extruder or like means such that the core portion comprises one polymer and the sheath portion comprises another polymer. Then the olefin-based polymers are extruded through a spinneret with conjugate spinning nozzles designed to produce a desired concentric sheath-core configuration. The concentric sheath-core conjugate continuous fiber thus spun is cooled with a cooling fluid, then stretched to a predetermined finesses by drawing air, and deposited on a collecting belt in a predetermined thickness. The web is then subjected to an entanglement treatment, such as needle punching, water jetting or ultrasonic sealing, or thermal bonding with a hot embossing roll. The desired spunbonded nonwoven fabric comprising the concentric sheath-core conjugate fiber can be thus obtained. The hot embossing roll used in the thermal bonding may have an arbitrary embossing area percentage; preferably, the embossing area percentage will be 5 to 30%.

The extensible nonwoven fabric of the invention can be heat-embossed at low temperatures. As a result, fuzzing will rarely take place and wide applications including disposable diapers can be attained. Since he extensible nonwoven fabric of the invention can be embossed at a low temperature, it has an ability of reduction of energy costs in the production.

Figure 4:
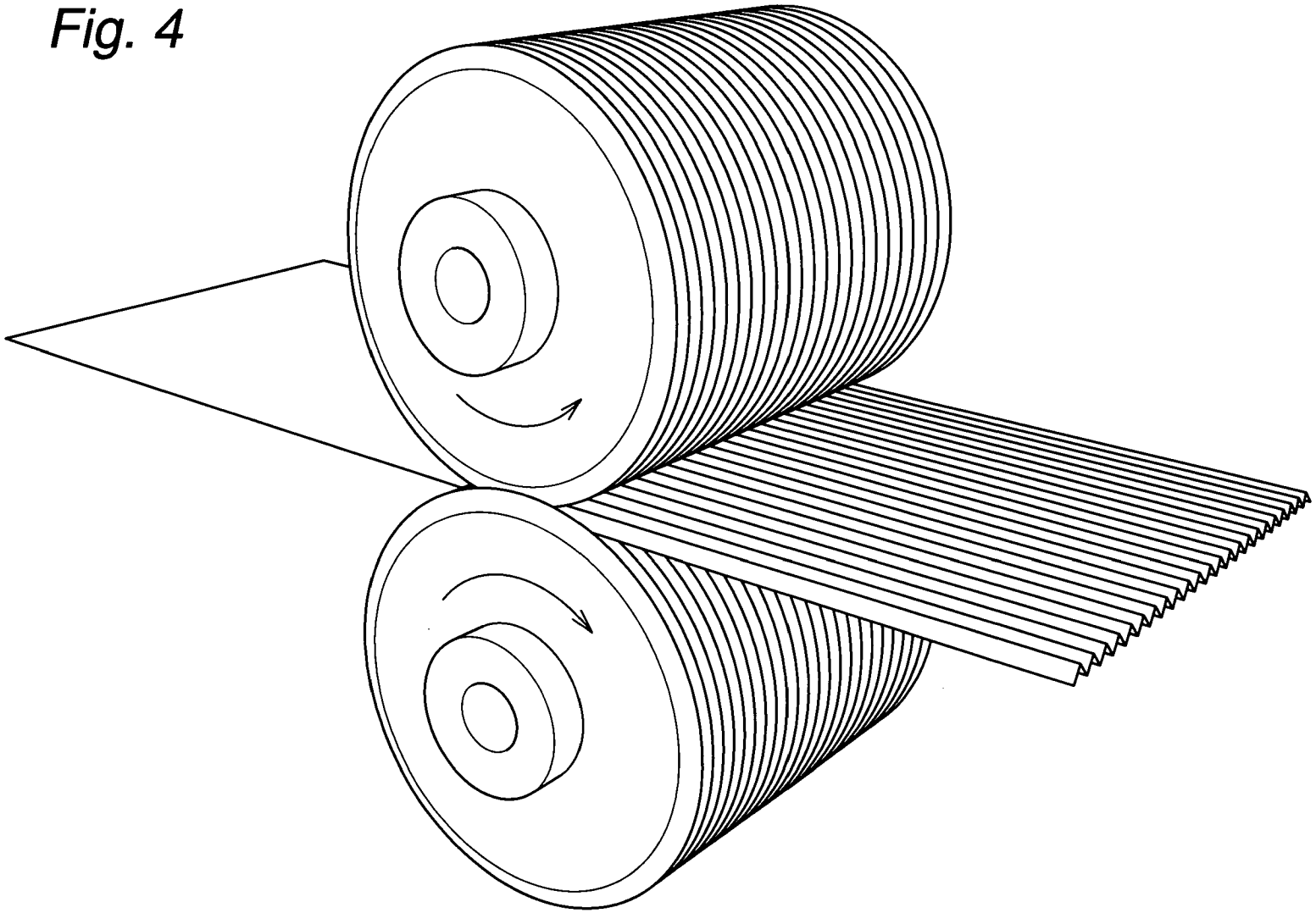
FIG. 4 is a schematic view illustrating stretching gears.

The extensible nonwoven fabric may be subjected to stretching by a common procedure. Stretching (elongating) in the machine direction (MD) may be performed by passing the extensible nonwoven fabric through two or more sets of nip rolls. In this stretching, each set of nip rolls will be operated faster than the previous set in the machine direction (MD). Further, gear stretching may be performed using stretching gears as shown in FIG. 4.

Composite Nonwoven Fabric

The composite nonwoven fabric according to the invention comprises at least one layer comprising the aforesaid extensible nonwoven fabric. Other layer (hereinafter the "other extensible layer") than the extensible nonwoven fabric contained in the composite nonwoven fabric is not particularly limited at least as long as it has extensibility. Preferably, the other extensible layer comprises an elastic polymer having both contraction and expansion properties.

The elastic polymers used include elastic materials having extensibility and contractility. Vulcanized gums and thermoplastic elastomers are suitable elastic materials. Particularly, thermoplastic elastomers are preferable due to their excellent formability. The thermoplastic elastomers are high-molecular materials that show elastic properties as do vulcanized rubbers at room temperature (which is due to the soft segments in the molecule) and that can be molded with a common molding machine at higher temperatures likewise with thermoplastic resins (which is due to the hard segments in the molecule).

The thermoplastic elastomers usable in the invention include urethane elastomers, styrene elastomers, polyester elastomers, olefin elastomers and polyamide elastomers.

The urethane elastomers are polyurethanes that are obtained by reaction of polyester or low molecular weight glycol with methylenebisphenyl isocyanate or tolylene diisocyanate. Examples thereof include adducts, such as polyether polyurethanes, resulting from addition polymerization of polyisocyanate to polylactone ester polyol in the presence of short-chain polyols; adducts, such as polyester polyurethanes, resulting from addition polymerization of polyisocyanate to polyol adipate formed from adipic acid and glycol, in the presence of short-chain polyols; and adducts obtained by addition polymerization of polyisocyanate to polytetramethylene glycol resulting from ring opening of tetrahydrofuran, in the presence of short chain polyols. These urethane elastomers are commercially available under the trademarks of Resamine (Dainichiseika Color & Chemicals Mfg. Co., Ltd.), Miractolan (Nippon Polyurethane Industry Co., Ltd.), Elastolan (BASF), Pandex and Desmopan (DIC-Bayer Polymer Ltd.), Estene (B.F. Goodrich) and Pellethane (Dow Chemical Company).

The styrene elastomers include styrene block copolymers, such as SEBS (styrene/(ethylene-butadiene)/styrene), SIS (styrene/isoprene/styrene), SEPS (styrene/(ethylene-propylene)/styrene) and SBS (styrene/butadiene/styrene). These styrene elastomers are commercially available under the trademarks of Kraton (Shell Chemicals), Cariflex TR (Shell Chemicals), Solprene (Phillips Petroleum Co.), Europrene SOL T (Enichem Elastomers), Tufprene (Asahi Kasei Corporation), Solprene T (Japan Elastomer Co., Ltd.), JSRTR (JSR Corporation), Denka STR (Denki Kagaku Kogyo K.K.), Quintac (Zeon Corporation), Kraton G (Shell Chemicals), Tuftec (Asahi Kasei Corporation) and Septon (Kuraray Co., Ltd.).

The polyester elastomers include those containing a hard segment comprising aromatic polyester and a soft segment comprising non-crystalline polyether or aliphatic polyester. Specific examples include polybutylene terephthalate/polytetramethylene ether glycol block copolymers.

The olefin elastomers include ethylene/$\alpha$-olefin random copolymers and those obtained by copolymerizing a diene as a third component to the random copolymers. Specific examples include those containing a hard segment comprising polyolefin and a soft segment comprising ethylene/propylene random copolymer, ethylene/1-butene random copolymer, or ethylene/propylene/diene copolymer (EPDM) such as ethylene/propylene/dicyclopentadiene copolymer or ethylene/propylene/ethylidene norbornene copolymer. These olefin elastomers are commercially available under the trademarks of Tafmer (Mitsui Chemicals Inc.) and Milastomer (Mitsui Chemicals Inc.).

The polyamide elastomers include those containing a hard segment comprising nylon and a soft segment comprising polyester or polyol. Specific examples include Nylon 12/polytetramethylene glycol block copolymers.

Of these, the urethane, styrene and polyester elastomers are preferred. Particularly, the urethane and styrene elastomers are preferred in view of excellent contraction and expansion properties.

The other extensible layer may be contained into various forms, including filament, net, film and foam. These layers can be produced by a common method.

The composite nonwoven fabric according to the invention can be obtained by bonding the layer of the extensible nonwoven fabric and the other extensible layer by a conventional method. The bonding methods include hot embossing, ultrasonic embossing, through hot-air bonding, needle punching, and adhesive bonding.

The adhesives for use in the adhesive bonding include resin adhesives such as vinyl acetate adhesives and polyvinyl alcohol adhesives, and rubber adhesives such as styrene/butadiene adhesives, styrene/isoprene adhesives and urethane adhesives. Solvent adhesives obtained by dissolving the aforesaid adhesives in organic solvents, and aqueous emulsion adhesives obtained from the aforesaid adhesives are also employable. Of these adhesives, the rubber hot melt adhesives, such as styrene/butadiene adhesives and styrene/isoprene adhesives, are preferably used since they do not deteriorate the texture.

The composite nonwoven fabric may be subjected to stretching by a common procedure likewise with the extensible nonwoven fabric.

Applications

The extensible nonwoven fabric and the composite nonwoven fabric according to the invention are excellent in extensibility, tensile strength, fuzz resistance, surface abrasion resistance, formability and productivity. Therefore, they can be used in wide industrial applications including medical, hygiene and wrapping products. In particular, they can be suitably used in disposable diapers.

EXAMPLES

The present invention will be described by the following Examples, but it should be construed that the invention is in no way limited to the Examples. The measurement and comparison procedures for the induction periods of strain-induced crystallization are described below. Also, the procedures in a tensile test and a fuzz resistance evaluation for the nonwoven fabrics are illustrated.

<Evaluation Procedures>

(1) Measurement of Induction Period of Strain-Induced Crystallization

The induction period of strain-induced crystallization was determined at a temperature between the equilibrium melting point and the static crystallization temperature of the polymer. The melt shear viscosity was measured at a constant temperature and a fixed shear strain rate to determine the induction period of strain-induced crystallization. The measurement was made first at around the equilibrium melting point, and when no increase in viscosity was observed within 7200 seconds from the measurement initiation, the measurement temperature was lowered and the melt shear viscosity was measured again. This procedure was repeated until the induction period of strain-induced crystallization was determined within 7200 seconds. The conditions in the measurement of the melt shear viscosity are given below.

Device: ARES Model produced by Rheometrics
Measurement mode: time sweep
Shear rate: 2.0 rad/s
Temperature: 130° C., 140° C., 150° C., 160° C., 170° C.
Tool: Cone plate (diameter: 25 mm)
Measurement environment: nitrogen atmosphere (2) Comparison of SIC Induction Periods The induction period of strain-induced crystallization of the polymers were compared at the temperature determined as described below. First, the highest measurement temperature that the induction period of strain-induced crystallization is determined within 7200 seconds was selected for each polymer (hereinafter the "selected temperature"). Thereafter, the induction periods of strain-induced crystallization of the polymers were compared at a comparison temperature which is the highest temperature among all the selected temperatures of the polymers employed.

(3) Measurement of Melt Flow Rate

The melt flow rate (MFR) was measured for the polymers in accordance with ASTM D1238. The conditions are as follows:

Polypropylene: 230° C. under 2.16 kg load
Polyethylene: 190° C. under 2.16 kg load (4) Measurement of Crystallization Temperature The crystallization temperature was measured by a differential scanning calorimeter (DSC). In the measurement, the polymer was heated to 200° C. at a rate of 10° C./min in a nitrogen atmosphere, maintained at this temperature for 10 minutes, and cooled to 30° C. at a rate of 10° C./min. The temperature at exothermic peak obtained in the cooling was determined as the crystallization temperature.

Based on the inventors' past experience in this field, the temperature higher than the crystalline temperature by 20° C. was determined as the static crystallization temperature.

(5) Tensile Test

Five specimens, each 25 mm in the machine direction (MD) and 2.5 mm in the cross direction (CD), were extracted from the nonwoven fabric. Another five specimens, each 2.5 mm in the MD and 25 mm in the CD, were extracted from the same nonwoven fabric. The former five specimens were subjected to a tensile test using a constant extension tensile tester under the conditions of chucks distance of 100 mm and a stress rate of 100 mm/min. The maximum load in the machine direction, the extensibility at the maximum load and the elongation at break (no load) were measured for the five specimens and the results were averaged. With respect to the latter five specimens too, the maximum load in the cross direction, the extensibility at the maximum load and the elongation at break were measured in the tensile test and the results were averaged.

(6) Fuzz Resistance Measurement (Brushing Test)

The fuzz resistance was determined in accordance with JIS L1076. Three specimens, each 25 mm in the MD and 20 mm in the CD, were extracted from the nonwoven fabric. The specimens were placed on a holder of a tester with brush and sponge. In the test, a felt was used instead of the brush and sponge, and the specimens were rubbed therewith 200 times at a rate of 58 rpm. The rubbed specimens were visually observed and the fuzz resistance was evaluated based on the following criteria.

(Evaluation Criteria)

5: no fuzzing
4: little fuzzing
3: some fuzzing

2: noticeable fuzzing but no fracture
1: noticeable fuzzing and fracture

<Polypropylenes>

Polypropylenes (PP1 to PP5) used in Examples and Comparative Examples had the properties illustrated in Table 1.

TABLE 1

| | PP1 | PP2 | PP3 | PP4 | PP5 |
|---|---|---|---|---|---|
| SIC induction period (sec) | | | | | |
| 170° C. | >7200 | >7200 | >7200 | >7200 | >7200 |
| 160° C. | >7200 | >7200 | >7200 | >7200 | >7200 |
| 150° C. | >7200 | >7200 | >7200 | >7200 | >7200 |
| 140° C. | 279 | 319 | 399 | >7200 | >7200 |
| 130° C. | Not measured | Not measured | Not measured | 719 | 1479 |
| MFR (g/10 min) | 15 | 30 | 60 | 60 | 60 |
| Melting point (° C.) | 162 | 162 | 162 | 142 | 138 |
| Mw/Mn | 3.0 | 2.8 | 2.6 | 2.8 | 2.5 |
| Ethylene unit content (mol %) | 0 | 0 | 0 | 4 | 5 |
| Crystallization temperature (° C.) | 116 | 116 | 116 | 101 | 94 |
| Static crystallization temperature (° C.) | 136 | 136 | 136 | 121 | 114 |

Example 1

PP1 and PP3 were melt spun into conjugate fibers which comprise the core portion of PP1 and the sheath portion of PP3. The resultant conjugate fibers having the concentric sheath-core configuration with a weight ratio of the core portion to the sheath portion of 10/90 (PP1/PP3) were deposited on a collecting surface. The deposit was then heated and pressed with an embossing roll (embossing area percentage: 18%, embossing temperature: 120° C.) to give a spunbonded nonwoven fabric having a basis weight of 25 g/m$^2$ and a fiber fineness of 3.5 denier. The spunbonded nonwoven fabric was tested to determine its properties. The results are shown in Table 2.

Example 2

A spunbonded nonwoven fabric was produced with the procedure illustrated in Example 1 except that PP4 was used in place of PP3 in the sheath portion and that the embossing temperature was changed from 120° C. to 100° C. The spunbonded nonwoven fabric was tested to determine its properties. The results are shown in Table 2.

Example 3

A spunbonded nonwoven fabric was produced with the procedure illustrated in Example 1 except that PP5 was used in place of PP3 in the sheath portion and that the embossing temperature was changed from 120° C. to 80° C. The spunbonded nonwoven fabric was tested to determine its properties. The results are shown in Table 2.

Example 4

A spunbonded nonwoven fabric was produced with the procedure illustrated in Example 3 except that PP2 was used in place of PP1 in the core portion and that the embossing temperature was changed from 80° C. to 100° C. The spunbonded nonwoven fabric was tested to determine its properties. The results are shown in Table 2.

Example 5

A spunbonded nonwoven fabric was produced with the procedure illustrated in Example 1 except that the core/sheath weight ratio was changed from 10/90 to 20/80 and that the embossing temperature was changed from 120° C. to 100° C. The spunbonded nonwoven fabric was tested to determine its properties. The results are shown in Table 2.

Example 6

A spunbonded nonwoven fabric was produced with the procedure illustrated in Example 2 except that the core/sheath weight ratio was changed from 10/90 to 20/80 and that the embossing temperature was changed from 100° C. to 80° C. The spunbonded nonwoven fabric was tested to determine its properties. The results are shown in Table 2.

Example 7

A spunbonded nonwoven fabric was produced with the procedure illustrated in Example 3 except that the core/sheath weight ratio was changed from 10/90 to 20/80. The spunbonded nonwoven fabric was tested to determine its properties. The results are shown in Table 2.

Example 8

A spunbonded nonwoven fabric was produced with the procedure illustrated in Example 1 except that PP2 was used in place of PP1 in the core portion and that the core/sheath weight ratio was changed from 10/90 to 20/80. The spunbonded nonwoven fabric was tested to determine its properties. The results are shown in Table 2.

Example 9

A spunbonded nonwoven fabric was produced with the procedure illustrated in Example 4 except that the core/sheath weight ratio was changed from 10/90 to 20/80. The spunbonded nonwoven fabric was tested to determine its properties. The results are shown in Table 3.

Example 10

A spunbonded nonwoven fabric was produced with the procedure illustrated in Example 4 except that the core/sheath weight ratio was changed from 10/90 to 50/50 and that the embossing temperature was changed from 100° C. to 70° C. The spunbonded nonwoven fabric was tested to determine its properties. The results are shown in Table 3.

Example 11

A spunbonded nonwoven fabric was produced with the procedure illustrated in Example 9 except that PP3 was used in place of PP2 in the core portion. The spunbonded nonwoven fabric was tested to determine its properties. The results are shown in Table 3.

Example 12

A spunbonded nonwoven fabric was produced with the procedure illustrated in Example 1 except that embossing temperature was changed from 120° C. to 100° C. and that the fiber fineness was altered from 3.5 denier to 2.5 denier. The spunbonded nonwoven fabric was tested to determine its properties. The results are shown in Table 3.

Example 13

A spunbonded nonwoven fabric was produced with the procedure illustrated in Example 5 except that the fiber fineness was altered from 3.5 denier to 2.5 denier. The spunbonded nonwoven fabric was tested to determine its properties. The results are shown in Table 3.

Example 14

A spunbonded nonwoven fabric was produced with the procedure illustrated in Example 2 except that the fiber fineness was altered from 3.5 denier to 2.5 denier. The spunbonded nonwoven fabric was tested to determine its properties. The results are shown in Table 3.

Example 15

A spunbonded nonwoven fabric was produced with the procedure illustrated in Example 6 except that the fiber fineness was altered from 3.5 denier to 2.5 denier. The spunbonded nonwoven fabric was tested to determine its properties. The results are shown in Table 3.

Example 16

A spunbonded nonwoven fabric was produced with the procedure illustrated in Example 3 except that the fiber fineness was altered from 3.5 denier to 2.5 denier. The spunbonded nonwoven fabric was tested to determine its properties. The results are shown in Table 4.

Example 17

A spunbonded nonwoven fabric was produced with the procedure illustrated in Example 7 except that the fiber fineness was altered from 3.5 denier to 2.5 denier. The spunbonded nonwoven fabric was tested to determine its properties. The results are shown in Table 4.

Example 18

A spunbonded nonwoven fabric was produced with the procedure illustrated in Example 4 except that the fiber fineness was altered from 3.5 denier to 2.5 denier. The spunbonded nonwoven fabric was tested to determine its properties. The results are shown in Table 4.

Example 19

A spunbonded nonwoven fabric was produced with the procedure illustrated in Example 9 except that the fiber fineness was altered from 3.5 denier to 2.5 denier. The spunbonded nonwoven fabric was tested to determine its properties. The results are shown in Table 4.

Comparative Example 1

PP3 and a polyethylene (PE1) were used as the olefin-based polymers. The polyethylene (PE1) had MFR, as measured at 190° C. under a load of 2.16 kg in accordance with ASTM D1238, of 60 g/10 min, a density of 0.93 g/cm$^3$ and a melting point of 115° C.

A spunbonded nonwoven fabric was produced with the procedure illustrated in Example 11 except that PE1 was used in place of PP5 in the sheath portion and that the embossing temperature was changed from 100° C. to 110° C. The spunbonded nonwoven fabric was tested to determine its properties. The results are shown in Table 4.

Comparative Example 2

PP3 alone was melt spun and the monocomponent fiber was deposited on a collecting surface. The deposit was then heated and pressed with an embossing roll (embossing area percentage: 18%, embossing temperature: 130° C.) to give a spunbonded nonwoven fabric having a basis weight of 25 g/m$^2$ and a fiber fineness of 3.5 denier. The spunbonded nonwoven fabric was tested to determine its properties. The results are shown in Table 5.

Comparative Example 3

A spunbonded nonwoven fabric was produced with the procedure illustrated in Comparative Example 2 except that PP4 was used in place of PP3. The spunbonded nonwoven fabric was tested to determine its properties. The results are shown in Table 5.

Comparative Example 4

A spunbonded nonwoven fabric was produced with the procedure illustrated in Comparative Example 2 except that the fiber fineness was altered from 3.5 denier to 2.5 denier. The spunbonded nonwoven fabric was tested to determine its properties. The results are shown in Table 5.

Comparative Example 5

A spunbonded nonwoven fabric was produced with the procedure illustrated in Comparative Example 2 except that the embossing temperature was changed from 130° C. to 80° C. The spunbonded nonwoven fabric was tested to determine its properties. The results are shown in Table 5.

TABLE 2

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Core portion (A) | | | | | | | | |
| Resin | PP1 | PP1 | PP1 | PP2 | PP1 | PP1 | PP1 | PP2 |
| SIC induction period (140° C.) (sec) | 279 | 279 | 279 | 319 | 279 | 279 | 279 | 319 |
| MFR (g/10 min) | 15 | 15 | 15 | 30 | 15 | 15 | 15 | 30 |
| Melting point (° C.) | 162 | 162 | 162 | 162 | 162 | 162 | 162 | 162 |
| Sheath portion (B) | | | | | | | | |
| Resin | PP3 | PP4 | PP5 | PP5 | PP3 | PP4 | PP5 | PP3 |
| SIC induction period (140° C.) (sec) | 399 | >7200 | >7200 | >7200 | 399 | >7200 | >7200 | 399 |
| MFR (g/10 min) | 60 | 60 | 60 | 60 | 60 | 60 | 60 | 60 |

TABLE 2-continued

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Melting point (° C.) | | 162 | 142 | 138 | 138 | 162 | 142 | 138 | 162 |
| Core/Sheath weight ratio (A/B) | | 10/90 | 10/90 | 10/90 | 10/90 | 20/80 | 20/80 | 20/80 | 20/80 |
| Embossing temperature (° C.) | | 120 | 100 | 80 | 100 | 100 | 80 | 80 | 120 |
| Fiber fineness (d) | | 3.5 | 3.5 | 3.5 | 3.5 | 3.5 | 3.5 | 3.5 | 3.5 |
| Basis weight (g/m$^2$) | | 25 | 25 | 25 | 25 | 25 | 25 | 25 | 25 |
| Extensibility at maximum load (%) | MD | 191 | 201 | 177 | 123 | 157 | 186 | 192 | 80 |
| | CD | 161 | 177 | 163 | 124 | 92 | 156 | 140 | 60 |
| Elongation at break (%) | MD | 199 | 221 | 187 | 132 | 167 | 201 | 202 | 93 |
| | CD | 169 | 185 | 176 | 134 | 125 | 176 | 158 | 82 |
| Fuzz resistance | | 5 | 5 | 5 | 5 | 5 | 5 | 5 | 5 |

TABLE 3

| | | Ex. 9 | Ex. 10 | Ex. 11 | Ex. 12 | Ex. 13 | Ex. 14 | Ex. 15 |
|---|---|---|---|---|---|---|---|---|
| Core portion (A) | | | | | | | | |
| Resin | | PP2 | PP2 | PP3 | PP1 | PP1 | PP1 | PP1 |
| SIC induction period (140° C.) (sec) | | 319 | 319 | 399 | 279 | 279 | 279 | 279 |
| MFR (g/10 min) | | 30 | 30 | 60 | 15 | 15 | 15 | 15 |
| Melting point (° C.) | | 162 | 162 | 162 | 162 | 162 | 162 | 162 |
| Sheath portion (B) | | | | | | | | |
| Resin | | PP5 | PP5 | PP5 | PP3 | PP3 | PP4 | PP4 |
| SIC induction period (140° C.) (sec) | | >7200 | >7200 | >7200 | 399 | 399 | >7200 | >7200 |
| MFR (g/10 min) | | 60 | 60 | 60 | 60 | 60 | 60 | 60 |
| Melting point (° C.) | | 138 | 138 | 138 | 162 | 162 | 142 | 142 |
| Core/Sheath weight ratio (A/B) | | 20/80 | 50/50 | 20/80 | 10/90 | 20/80 | 10/90 | 20/80 |
| Embossing temperature (° C.) | | 100 | 70 | 100 | 100 | 100 | 100 | 80 |
| Fiber fineness (d) | | 3.5 | 3.5 | 3.5 | 2.5 | 2.5 | 2.5 | 2.5 |
| Basis weight (g/m$^2$) | | 25 | 25 | 25 | 25 | 25 | 25 | 25 |
| Extensibility at maximum load (%) | MD | 123 | 81 | 95 | 149 | 141 | 174 | 170 |
| | CD | 178 | 50 | 89 | 103 | 101 | 140 | 143 |
| Elongation at break (%) | MD | 131 | 128 | 102 | 167 | 171 | 183 | 175 |
| | CD | 192 | 112 | 108 | 127 | 135 | 158 | 159 |
| Fuzz resistance | | 5 | 5 | 5 | 5 | 5 | 5 | 5 |

TABLE 4

| | | Ex. 16 | Ex. 17 | Ex. 18 | Ex. 19 | Comp. Ex. 1 |
|---|---|---|---|---|---|---|
| Core portion (A) | | | | | | |
| Resin | | PP1 | PP1 | PP2 | PP2 | PP3 |
| SIC induction period (140° C.) (sec) | | 279 | 279 | 319 | 319 | 399 |
| MFR (g/10 min) | | 15 | 15 | 30 | 30 | 60 |
| Melting point (° C.) | | 162 | 162 | 162 | 162 | 162 |
| Sheath portion (B) | | | | | | |
| Resin | | PP5 | PP5 | PP5 | PP5 | PE1 |
| SIC induction period (140° C.) (sec) | | >7200 | >7200 | >7200 | >7200 | — |
| MFR (g/10 min) | | 60 | 60 | 60 | 60 | 60 (190° C.) |
| Melting point (° C.) | | 138 | 138 | 138 | 138 | 115 |
| Core/Sheath weight ratio (A/B) | | 10/90 | 20/80 | 10/90 | 20/80 | 20/80 |
| Embossing temperature (° C.) | | 80 | 80 | 100 | 100 | 110 |
| Fiber fineness (d) | | 2.5 | 2.5 | 2.5 | 2.5 | 3.5 |
| Basis weight (g/m$^2$) | | 25 | 25 | 25 | 25 | 25 |
| Extensibility at maximum load (%) | MD | 164 | 129 | 116 | 119 | 157 |
| | CD | 138 | 188 | 160 | 144 | 157 |
| Elongation at break (%) | MD | 173 | 142 | 123 | 128 | 169 |
| | CD | 154 | 197 | 169 | 155 | 172 |
| Fuzz resistance | | 5 | 5 | 5 | 5 | 1 |

TABLE 5

| | | Comp. Ex. 2 | Comp. Ex. 3 | Comp. Ex. 4 | Comp. Ex. 5 |
|---|---|---|---|---|---|
| Resin | | PP3 | PP4 | PP3 | PP3 |
| SIC induction period (140° C.) (sec) | | 399 | >7200 | 399 | 399 |
| MFR (g/10 min) | | 60 | 60 | 60 | 60 |
| Melting point (° C.) | | 162 | 142 | 162 | 162 |
| Embossing temperature (° C.) | | 130 | 130 | 130 | 80 |
| Fineness (d) | | 3.5 | 3.5 | 2.5 | 3.5 |
| Basis weight (g/m$^2$) | | 25 | 25 | 25 | 25 |
| Extensibility at maximum load (%) | MD | 47 | 69 | 26 | 22 |
| | CD | 39 | 55 | 35 | 29 |
| Elongation at break (%) | MD | 61 | 75 | 50 | 72 |
| | CD | 64 | 60 | 56 | 91 |
| Fuzz resistance | | 5 | 5 | 5 | 1 |

Example 20

PP1 and PP3 were melt spun into conjugate fibers which comprise the core portion of PP1 and the sheath portion of PP3. The resultant conjugate fibers having the concentric sheath-core configuration with a weight ratio of the core portion to the sheath portion of 10/90 (PP1/PP3) were deposited on a collecting surface. Thereon, SEPS (styrene/(ethylene-propylene)/styrene) block copolymer (trade name: SEPS 2002 available from Kuraray Co., Ltd.) was spread by a common meltblowing process to produce a laminate. Thereafter, PP1 and PP3 were melt spun into a concentric sheath-core conjugate fibers, and the resultant fibers were deposited on the above-obtained laminate. The concentric sheath-core conjugate fibers had the core portion of PP1 and the sheath portion of PP3 with a core/sheath weight ratio of 10/90. The resultant laminate (web) was then heated and pressed with an embossing roll (embossing area percentage: 18%, embossing temperature: 120° C.) to give a spunbonded/meltblown/spunbonded nonwoven fabric having a basis weight of 130 g/m$^2$.

Figure 5:
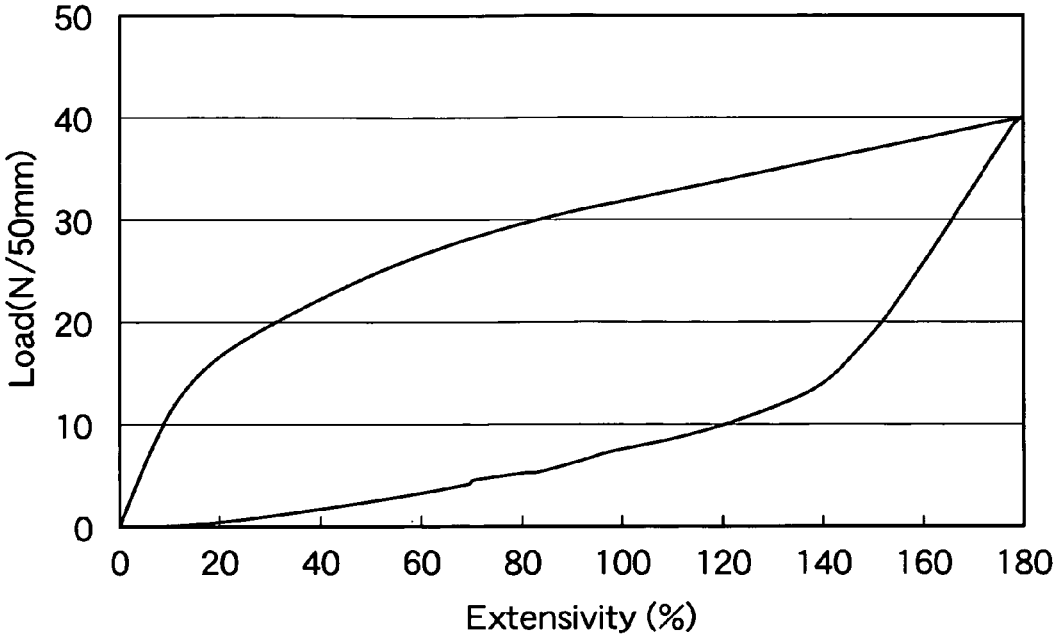
FIG. 5 is a stress-strain curve obtained by a tensile test for composite nonwoven fabrics resulting in Examples.
Figure 6:
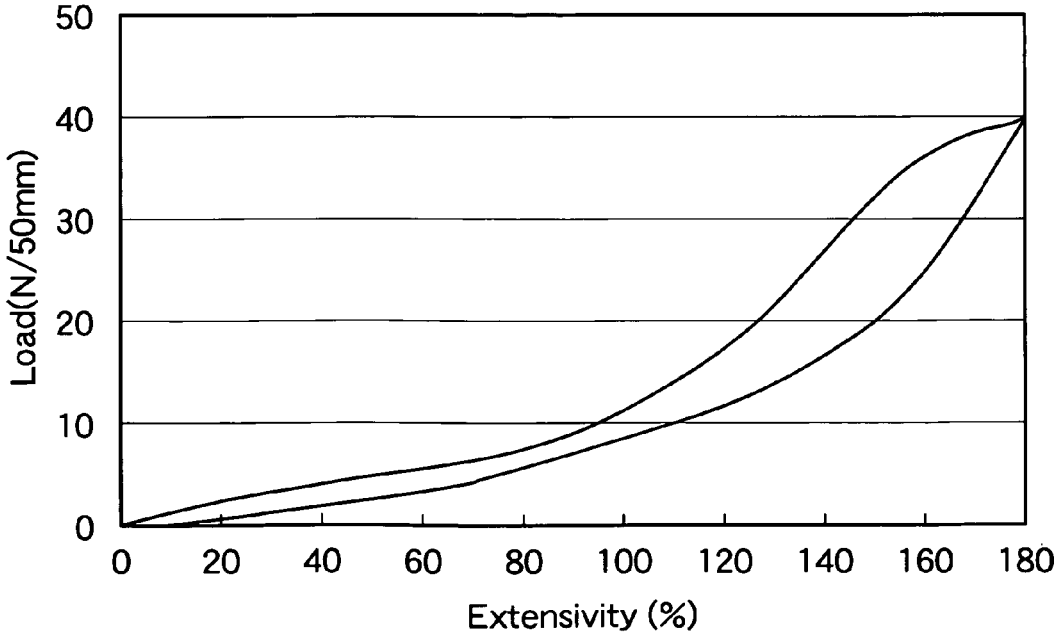
FIG. 6 is a stress-strain curve obtained by a tensile retest for the composite nonwoven fabrics illustrated in FIG. 5.

A 50 mm wide specimen was extracted from the nonwoven fabric. The specimen was elongated to 180% of its original length by means of a tensile tester and thereafter relaxed to 0% elongation. The stress-strain curve obtained in the test is shown in FIG. 5. Thereafter, the specimen was again elongated to 180% of its original length and thereafter relaxed to 0% elongation. The stress-strain curve obtained in this second test is shown in FIG. 6. There ware no filament fracture or the like in the spunbonded nonwoven fabric layer after the tensile tests. The fuzz resistance test resulted in the evaluation of 5.

INDUSTRIAL APPLICABILITY

The invention provides an extensible nonwoven fabric and a composite nonwoven fabric comprising the extensible nonwoven fabric, both being excellent in extensibility, tensile strength, fuzz resistance, surface abrasion resistance, formability and productivity. They can be used in wide industrial applications including medical, hygiene and wrapping products. In particular, they can be suitably used in disposable diapers due to their comfortable touch attributed to excellent fuzz resistance.

The invention claimed is:

1. An extensible nonwoven fabric which is a spunbonded nonwoven fabric that comprises a fiber having substantially no crimps and comprising at least two olefin-based polymers, said at least two olefin-based polymers being of the same kind and having a difference between induction periods of strain-induced crystallization, as measured at the same temperature and the same shear strain rate, of 100 seconds or longer, wherein among the at least two olefin polymers constituting the fiber, the olefin-based polymer having the earliest induction period of strain-induced crystallization is contained in an amount of 1 to 20 wt % of the fiber, and wherein the fiber is a conjugate fiber having a concentric sheath-core configuration, in which the core resin has the earliest induction period of strain-induced crystallization.

2. The extensible nonwoven fabric according to claim 1, which has an extensibility at a maximum load of not less than 70% in the machine direction (MD) and/or in the cross machine direction (CD).

3. The extensible nonwoven fabric according to claim 1, wherein the olefin-based polymer is a propylene-based polymer.

4. A composite nonwoven fabric comprising at least one layer comprising the extensible nonwoven fabric as described in claim 1.

5. A disposable diaper comprising the extensible nonwoven fabric as described in claim 1.

* * * * *